US005515566A

United States Patent [19]

Ganon

[11] Patent Number: 5,515,566

[45] Date of Patent: May 14, 1996

[54] MOCCASIN CONSTRUCTION AND METHOD OF FORMING SAME

[75] Inventor: Michael H. Ganon, Columbus, Ohio

[73] Assignee: Sara Lee Corporation, Winston-Salem, N.C.

[21] Appl. No.: 495,191

[22] Filed: Jun. 27, 1995

[51] Int. Cl.[6] ..... A43B 3/14; A43B 9/08

[52] U.S. Cl. ..... 12/142 MC; 12/142 A; 36/19 R; 36/11

[58] Field of Search ..... 12/142 B, 142 MC, 12/142 A; 36/11, 17 A, 19 A, 19 R, 12

[56] References Cited

U.S. PATENT DOCUMENTS

| | | | |
|---|---|---|---|
| 1,916,067 | 6/1933 | Naidor | 36/19 A |
| 2,232,215 | 2/1941 | Cordeau | 36/11 |
| 2,999,323 | 9/1961 | Bozza | 36/11 |
| 3,676,883 | 7/1972 | Peacock | 12/142 MC |
| 5,392,532 | 2/1995 | Bray, Jr. et al. | 36/19 A X |

FOREIGN PATENT DOCUMENTS

| | | | |
|---|---|---|---|
| 0563330 | 5/1957 | Italy | 12/142 MC |

*Primary Examiner*—Ted Kavanaugh

[57] ABSTRACT

A moccasin construction and method for making same having an articulated lining wherein a body liner is attached to a body vamp at preselected locations, the sole is attached to the joined body liner and body vamp, a sole liner is partially attached to the joined sole, body liner and body vamp, and the joined elements are then everted so that the sole liner and sole form a cavity to receive an insole. The sole liner is then secured to the sole, body liner and body vamp to encapsulate the insole and form a complete and everted moccasin. The everted moccasin is once again everted so that the completed moccasin is positioned in a wearable foot-receiving condition. Thus, the body vamp and body liner are loose, the insole is loosely maintained between the sole lining and sole, and all sewing construction is everted.

14 Claims, 2 Drawing Sheets

MOCCASIN CONSTRUCTION AND METHOD OF FORMING SAME

BACKGROUND OF THE INVENTION

1. Field of the Invention

The present invention relates generally to moccasins and more particularly to a new moccasin construction and method for forming that construction.

2. Description of the Prior Art

Casual shoes, particularly characterized as Indian moccasins usually consist of four basic leather components that include a vamp, usually of one piece construction; linings that are glued on the entire vamp; insoles that are glued on a particular area of the lining; a sole that is stitched around the vamp; no eyelets for lacing or thread; and a lacing thread which is waxed. Thus, the construction is generally all glued and stitched. Such a moccasin is adequate for casual wear however not generally comfortable for use over an extended period of time because of the solid glued construction and absence of a close foot fit.

Conventional moccasin construction is also somewhat time consuming since all of the gluing is done over the entire surface of the glued together components. In particular, glued insoles do not represent a desirable or comfortable feature. Certain sewing operations are not susceptible to automation and therefore do extend the construction time for conventional moccasins to some degree.

With the desire to increase the comfort associated with wearing casual moccasins and to improve the construction efficiency, the present invention has been developed.

SUMMARY AND OBJECTIVES OF THE INVENTION

The present invention is formed from a body vamp, a body liner, a sole, a sole liner and an insole with the body vamp and body liner having discreet features that are selectively joined together and to other components in a predetermined fashion. The sole is subsequently attached to the joined body liner and body vamp and a sole liner is partially attached to the joined sole, body liner and body vamp so that upon eversion, a cavity is formed between the sole and the sole liner to receive an insole. The sole liner is then completely secured to the sole, body liner and body vamp to encapsulate the insole and form a complete and everted moccasin. The moccasin is thereafter everted again to place it in a wearable foot-receiving condition and to receive lacing to further secure the body vamp and enable the moccasin to be tightened around the foot of a wearer.

From the foregoing summary, it can be discerned that a primary objective of the present invention is to provide a new moccasin construction which will include all of the advantages and more of prior art moccasin construction and none of the disadvantages.

Another objective of the present invention is to provide a moccasin construction having an articulated lining.

A further objective of the present invention is to provide a moccasin construction of the type described that eliminates the gluing steps normally associated with prior art moccasins.

Yet another objective of the present invention is to provide a moccasin construction of the type described that provides eyelets for lacing and where the vamp and lining are inseamed on the sole.

Yet still another further objective of the present invention is to provide a moccasin construction of the type described that enables improved efficiencies in the construction process.

Yet still another further objective of the present invention is to provide a method of forming a new moccasin construction with an articulated lining where all sewing operations are everted.

Yet still another further objective of the present invention is to provide a method of forming a new moccasin construction that is more efficient and results in a more sophisticated product than prior art methods.

Thus there has been outlined the more important features of the invention in order that the detailed description that follows may be better understood and in order that the present contribution to the art may be better appreciated. There are additional features of the invention that will be described hereinafter and which will form the subject matter of the claims appended hereto. In this respect, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate the concept upon which this disclosure is based and that it may readily be utilized as a basis for designing other structures, methods and systems for carrying out the several purposes of this development. It is important that the claims be regarded as including such equivalent constructions insofar as they do not depart from the spirit and scope of the present invention.

Thus the objectives set forth above, together with other objectives of the invention, along with the various features of novelty which characterize the invention will become more apparent after consideration of the following detailed description of the invention taken in conjunction with the accompanying drawings wherein like characters of reference designate like parts throughout the several views.

DETAILED DESCRIPTION OF THE PREFERRED EMBODIMENT

Figure 1:
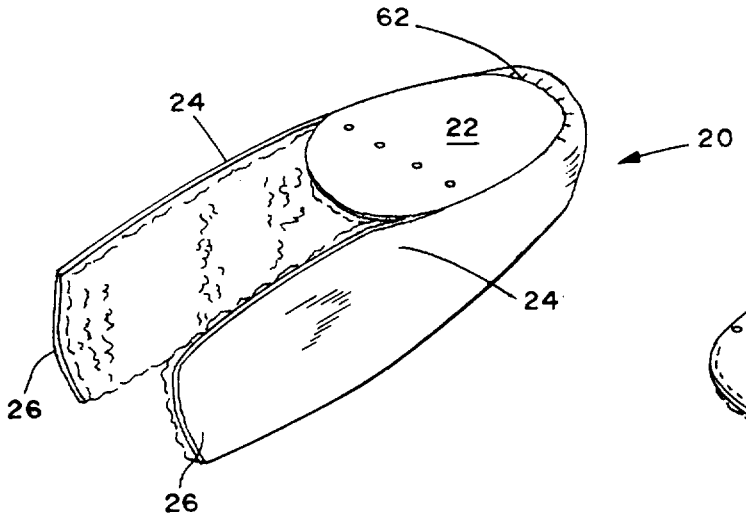
FIG. 1 is the body liner of the moccasin comprising the present invention which includes a top liner, corresponding side liners and heel liners to be joined in a later construction operation.
Figure 2:
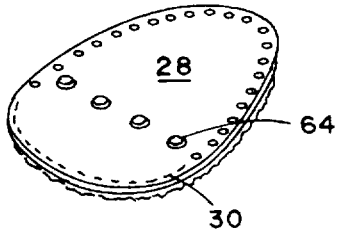
FIG. 2 illustrates the top vamp which is a part of the body vamp of the moccasin comprising the present invention.
Figure 3:
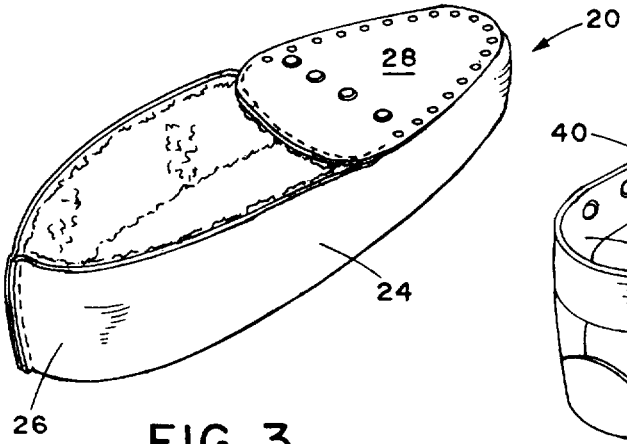
FIG. 3 illustrates the body liner in the heel joined condition and the partial attachment of the top vamp thereto.

Referring now to the drawings and particularly to FIG. 1 a pre-cut body liner shown generally as 20 includes a top liner 22, side liners 24 and heel liners 26 which will subsequently be joined together to form a heel portion. A top vamp 28 (FIG. 2) is partially secured to top liner 22 by stitches 30 so that body liner 20 then carries the joined components 22, 28 as illustrated in FIG. 3.

Figure 4:
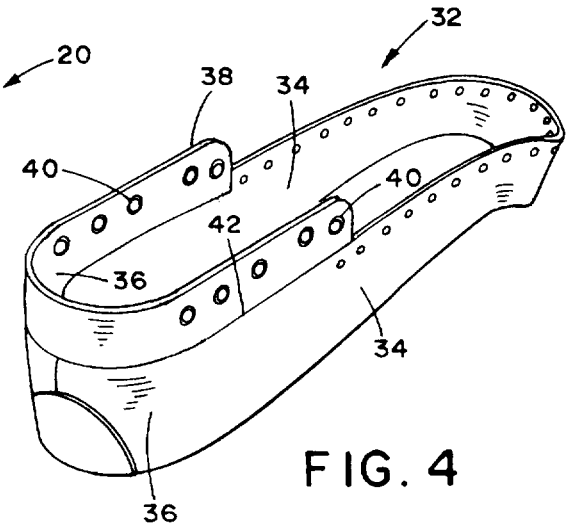
FIG. 4 is a perspective view of the body vamp showing the attached cuff and joined heel vamps.

A body vamp shown generally as 32 includes side vamps 34, the top vamp 28 previously described but unattached in FIG. 4, and heel vamps 36 which have been joined to form a vamp heel portion. A cuff 38 having eyelets 40 is secured to the upper edge of body vamp 32 along its lower edge 42 as shown in FIG. 4.

Figure 5:
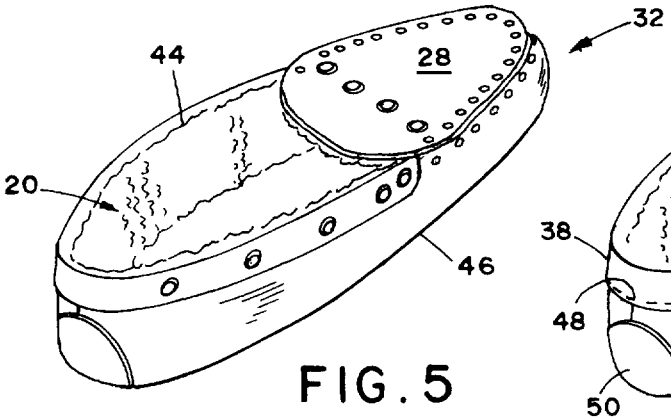
FIG. 5 is a perspective view of the body vamp partially secured to the body liner.

In FIG. 5, body vamp 32 has been sewn to body liner 20 along upper edge 44 and lower edge 46. Top vamp 28 remains unattached to body vamp 32 for the moment.

Figure 6:
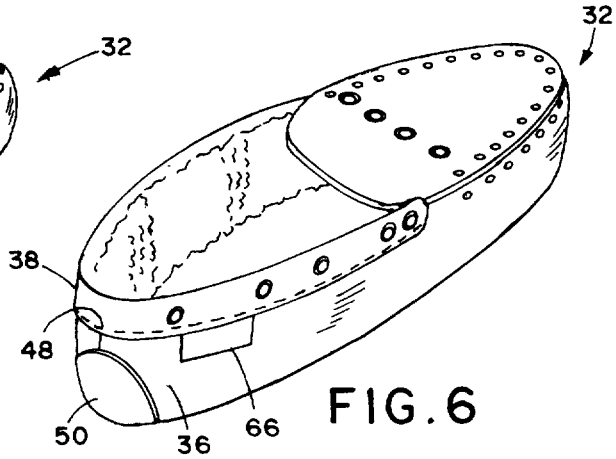
FIG. 6 shows the construction of FIG. 5 wherein the cuff has been stitched to the body vamp and a heel tab has been secured to the heel vamps.

Cuff 38 is sewn along its lower edge to body vamp 32 along sewing line 48 as shown in FIG. 6. A heel tab 50 is secured to heel vamps 36 as also shown in FIG. 6.

Figure 7:
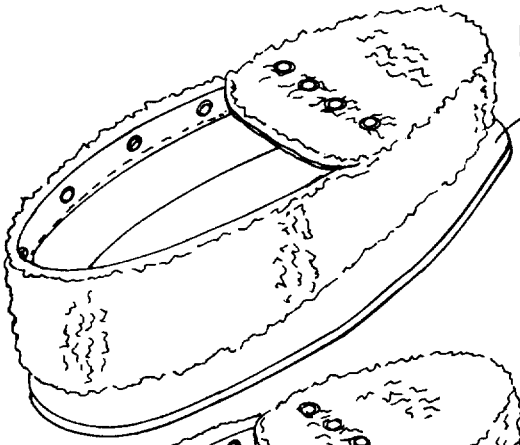
FIG. 7 is a perspective view of the moccasin construction shown in FIG. 6 which has been everted and to which is being attached a sole.
Figure 9:
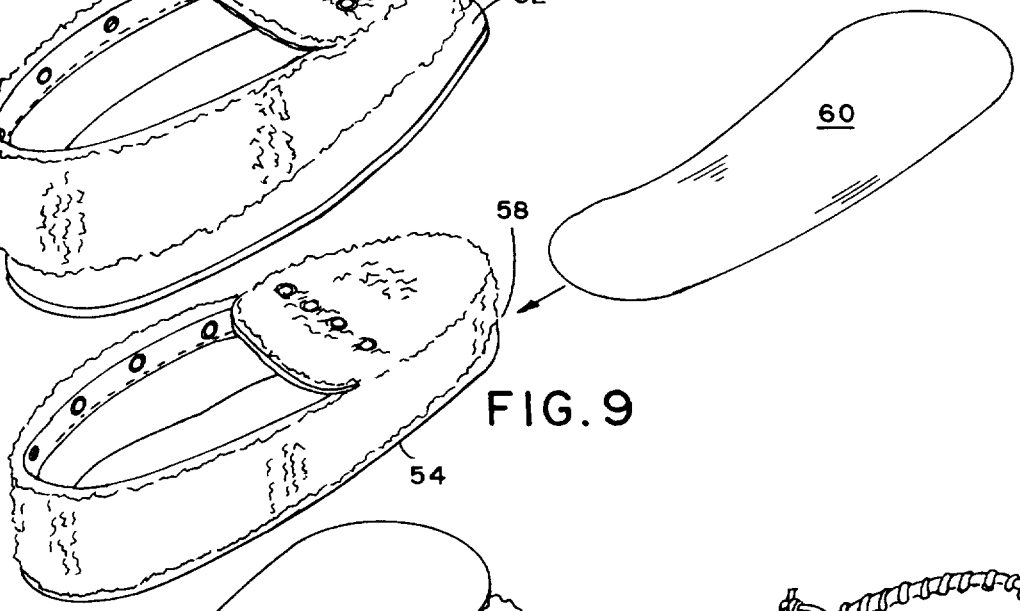
FIG. 9 is a perspective view of the moccasin construction of FIG. 8 wherein the body vamp, body liner and sole has again been everted to expose a formed cavity into which an insole is inserted.
Figure 8:
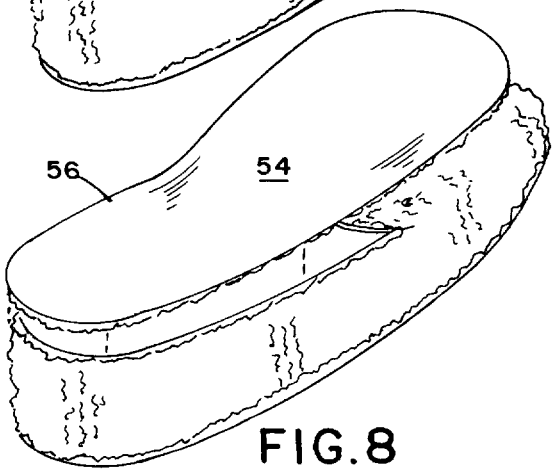
FIG. 8 is a perspective view of the moccasin construction shown in FIG. 7 wherein a sole liner is being partially secured to the everted and joined body vamp, body liner and sole.

The connected body liner and body vamp is now everted (FIG. 7) and a sole 52 is sewn along the lower edge of these connected components. To this construction is applied a sole liner as shown in FIG. 8 which is partially attached to the connected body vamp, body liner and sole along its periphery 56. The liner is not sewn along the top portion at this time. These joined components are then everted so that sole liner 54 is adjacent sole 52 and forms a cavity 58 as shown in FIG. 9. An insole 60 is then inserted into cavity 58, and insole 54 is completely joined to sole 52 along the toe portion thereby encapsulating insole 60 between the two components.

Figure 10:
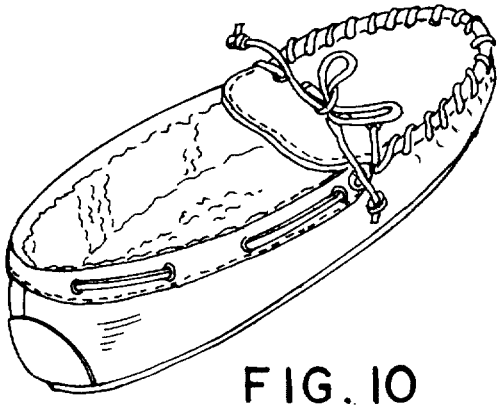
FIG. 10 is a perspective view of the moccasin construction shown in FIG. 9 which is once again everted and completed with the application of lacing.

The connected components are once again everted to place the moccasin in a wearable foot-receiving condition as shown in FIG. 10 to which has been added lacing that further secures the body vamp by connecting top vamp 28 to side vamps 34 and enables the moccasin to be tightened around the foot of a wearer by extending around cuff 38 through eyelets 40 in the manner shown.

Additional comfort enhancing steps are taken during the fabricating process such as gathering the top edge 62 of body liner 20 to provide a contoured toe section. Eyelets 64 also serve to connect top liner 22 with top vamp 28 and result in a finished product of superior appearance. An appropriate tag 66 (FIG. 6) may also be applied to the shoe when cuff 38 is seamed along sewing line 48 to heel vamp 36.

Thus it can be seen that the objective of providing an improved moccasin with an articulated lining has been achieved which utilizes selectively sewing the body liner and body vamp together and applying a sole liner to form a cavity for receiving an insole. The costly and uncomfortable gluing of these various components is eliminated and decorative and functional eyelets are applied to the top vamp and cuff.

From the preceding description, it can be seen that a moccasin construction and method for providing same has been provided that will meet and exceed all of the advantages of prior art processes and offer additional advantages not offered by such processes. With respect to the foregoing description, the optimum dimensional relationship to the parts of the invention including variations in size, materials, shape, form, function, and manner of operation, use and assembly, are deemed readily apparent and obvious to those skilled in the art and all equivalent relationships illustrated in the drawings and described in the specification are intended to be encompassed herein.

Therefore, the foregoing is considered as illustrative only of the principles of the invention. Further, since numerous modifications and changes will readily occur to those skilled in the art, it is not desired to limit the invention to the exact construction and operation shown and described. All suitable modifications and equivalents that fall within the scope of the appended claims are deemed within the present inventive concept.

What is claimed is:

1. A method of forming a moccasin with an articulated lining from a body vamp having a top edge and a sole-engaging bottom edge, a body vamp liner, a top vamp, a top vamp liner, a sole, a sole liner, and an insole comprising the steps of: joining the top vamp to the top vamp liner; joining the body liner to the body vamp; joining the top vamp and top vamp liner to the body vamp and body vamp liner along the body vamp top edge; attaching the sole to the joined body liner and body vamp along the body vamp sole-engaging bottom edge; partially attach a sole liner to the joined sole, body vamp liner and body vamp; everting the partially attached sole liner, sole, body liner and body vamp to form a cavity between the sole and the sole liner; inserting an insole into the formed cavity; completing the attachment of a sole liner to the sole, body liner and body vamp to encapsulate the insole and form a complete and everted moccasin; and evert the completed moccasin to place the moccasin in a wearable foot-receiving condition.

2. The method as claimed in claim 1 wherein the body vamp includes side vamps and heel vamps and the body liner includes corresponding side liners and heel liners secured to each other at predetermined locations.

3. The method as claimed in claim 2 wherein the body vamp further includes a heel tab positioned against and joined to the heel vamps.

4. The method as claimed in claim 3 further comprising the step of providing the completed moccasin with lacing to further secure the body vamp and enable the moccasin to be tightened around the foot of the wearer.

5. A method as claimed in claim 2 wherein the body vamp includes a cuff.

6. The method as claimed in claim 2 wherein the body vamp further includes a heel tab positioned against and joined to the heel vamps.

7. The method as claimed in claim 2 further comprising the step of providing the completed moccasin with lacing to further secure the body vamp and enable the moccasin to be tightened around the foot of the wearer.

8. The method as claimed in claim 1 wherein the body vamp includes a cuff.

9. The method as claimed in claim 8 further comprising the step of providing the completed moccasin with lacing to further secure the body vamp and enable the moccasin to be tightened around the foot of the wearer.

10. The method as claimed in claim 1 further comprising the step of providing the completed moccasin with lacing to further secure the body vamp and enable the moccasin to be tightened around the foot of a wearer.

11. A method of forming a moccasin from a body vamp having a top edge and sole-engaging bottom edge, a top vamp, a sole, a sole liner, and an insole comprising the steps of: joining the top vamp to the body vamp top edge; joining the body vamp sole-engaging bottom edge to the sole; partially attaching the sole liner to the joined body vamp sole-engaging bottom edge and the sole; everting the partially attached sole liner and the joined body vamp sole-engaging bottom edge and sole to form a cavity between the sole and sole liner; inserting an insole into the formed cavity; completing the attachment of the sole liner to the joined body vamp sole-engaging bottom edge insole to encapsulate the insole and form a complete and everted moccasin; and everting the completed moccasin to place the moccasin in a wearable foot-receiving condition.

12. The method as claimed in claim 11 wherein the body vamp includes a cuff.

13. The method as claimed in claim 11 wherein the body vamp includes a heel tab.

14. The method as claimed in claim 11 including the step of further providing the completed moccasin with lacing to further secure the body vamp and enable the moccasin to be tightened around the foot of the wearer.

* * * * *